United States Patent [19]

Leone et al.

[11] Patent Number: 4,871,889

[45] Date of Patent: Oct. 3, 1989

[54] ARCING CONTACT ASSEMBLY FOR A CIRCUIT BREAKER

[75] Inventors: David A. Leone; Clifford A. Buxton, both of Lawrenceville, Ga.

[73] Assignee: Siemens Energy & Automation, Inc., Atlanta, Ga.

[21] Appl. No.: 247,462

[22] Filed: Sep. 21, 1988

[51] Int. Cl.[4] ..... H01H 33/12

[52] U.S. Cl. ..... 200/146 R; 200/144 R

[58] Field of Search ..... 200/146 R

[56] References Cited

U.S. PATENT DOCUMENTS

| | | | |
|---|---|---|---|
| 3,365,561 | 1/1968 | Jencks et al. | 200/166 |
| 3,560,683 | 2/1971 | Maier et al. | 200/146 |
| 3,585,329 | 6/1971 | Walker et al. | 200/146 |
| 3,735,075 | 5/1973 | Kidd | 200/146 |
| 3,770,922 | 11/1973 | Gryctko | 200/146 |
| 4,137,437 | 1/1979 | Maier et al. | 200/153 |
| 4,166,205 | 8/1979 | Maier et al. | 200/153 |
| 4,219,713 | 8/1980 | Maier et al. | 200/153 |
| 4,229,630 | 10/1980 | Wafer et al. | 200/144 |
| 4,242,577 | 12/1980 | Maier et al. | 200/153 |
| 4,251,702 | 2/1981 | Castonguay et al. | 200/153 |
| 4,264,796 | 4/1981 | Nelson et al. | 200/153 |
| 4,295,021 | 10/1982 | Robins | 200/147 |
| 4,301,342 | 11/1981 | Castonguay et al. | 200/153 |
| 4,309,580 | 1/1982 | Wafer et al. | 200/144 |
| 4,580,021 | 4/1986 | Fujikake | 200/153 |
| 4,635,012 | 1/1987 | Kohanawa et al. | 335/16 |
| 4,713,504 | 12/1987 | Maier | 200/146 |

*Primary Examiner*—Robert S. Macon

*Attorney, Agent, or Firm*—James G. Morrow

[57] ABSTRACT

An assembly adapted to commutate arcs from between the main contacts of a circuit breaker to an arcing contact such that a single arc at the arcing contact can be extinguished and dispersed within an arc chute. The assembly is adapted to be pivotally attached to the ends of the main contact carrying arms and includes arc channeling members joined to form a contact surface. An arcing contact can be fixed to the contact surface such that the arcs from the main contacts are channelled into one arc at the arcing contact.

12 Claims, 2 Drawing Sheets

ARCING CONTACT ASSEMBLY FOR A CIRCUIT BREAKER

CROSS-REFERENCE TO RELATED APPLICATIONS

This patent application is related to the patent application entitled MOVING MAINS ARC MOVEMENT LOOP having Ser. No. 242,094 filed on Sept. 8, 1988.

BACKGROUND OF INVENTION

This invention relates to a circuit breaker, and more particularly, to a pivoting arcing contact assembly associated with the main current carrying contacts of the circuit breaker.

Under certain conditions, which are frequently present when the current carrying contacts of a circuit breaker are opened, an arc is generated between the contacts. Depending on the intensity and duration of the arc, the contact material, which in many cases is a precious metal, experiences varying degrees of deterioration and/or separation of the contact material from the contact carrying arms. For example, the contact surfaces can be eroded such that the resistance of the interfaces between contacts increases causing contact heating and further deterioration of the contacts.

To reduce the duration of arcing at the current carrying contacts, it is important to move the arcs from the contacts. This can be done by causing arcs generated at the contacts to commutate to a higher resistance less expensive material. Arc horns or arcing contacts can be used to perform this function. For example, U.S. Pat. No. 4,713,504 discloses an arcing contact hingedly mounted for reducing arcing between separating contacts.

Subsequent to moving arcs from between current carrying contacts to arcing contacts, it is important to extinguish the arcs and/or move the arcs into an arc chute. Accordingly, it would be advantageous to effectively commutate all of the arcs generated at the current carrying contacts in a way which consolidates all of the arcs into a single arc which can be extinguished and/or moved into an arc chute.

SUMMARY OF THE INVENTION

An object of the present invention is to provide an assembly which is adapted to funnel or channel arcs from the main contacts of a circuit breaker to a pair of arcing contacts where a single arc can be extinguished into an arc chute.

Accordingly, there is provided a circuit breaker comprising at least three stationary contacts for carrying current, at least three movable contacts for carrying current and at least three pivoting contact arms each defining a first end wherein each arm carries one movable contact at the first end. The improvement to the circuit breaker comprises at least two arc carrying leads each defining a first end and a second end. The first ends are joined to form an arcing contact surface, each of the second ends is positioned adjacent to a pivoting contact arm and each of the second ends is separated from an adjacent second end by the first end of a pivoting contact arm. The circuit breaker further includes a means for pivotally attaching the second ends of the arc carrying leads at the first ends of the pivoting contact arms.

An advantage of the present invention is that it provides means for carrying an arc from each movable contact to the arcing contact surface by providing an arc carrying lead adjacent to each pivoting contact arm. Additionally, the present invention has the advantage of eliminating the need to displace one or more pivoting contact arms with contact arms adapted to carry an arcing contact, wherein the contact arms are also pivoted at the pivot joint for the pivoting contact arms. An example of a contact arm for carrying an arcing contact which is pivoted at the pivot for the other contact arms is disclosed in U.S. Pat. 3,365,561.

Various other objects and advantages of the present invention will become apparent from the following description, with reference to the accompanying drawing.

DETAILED DESCRIPTION OF THE PREFERRED EMBODIMENT

Figure 1:
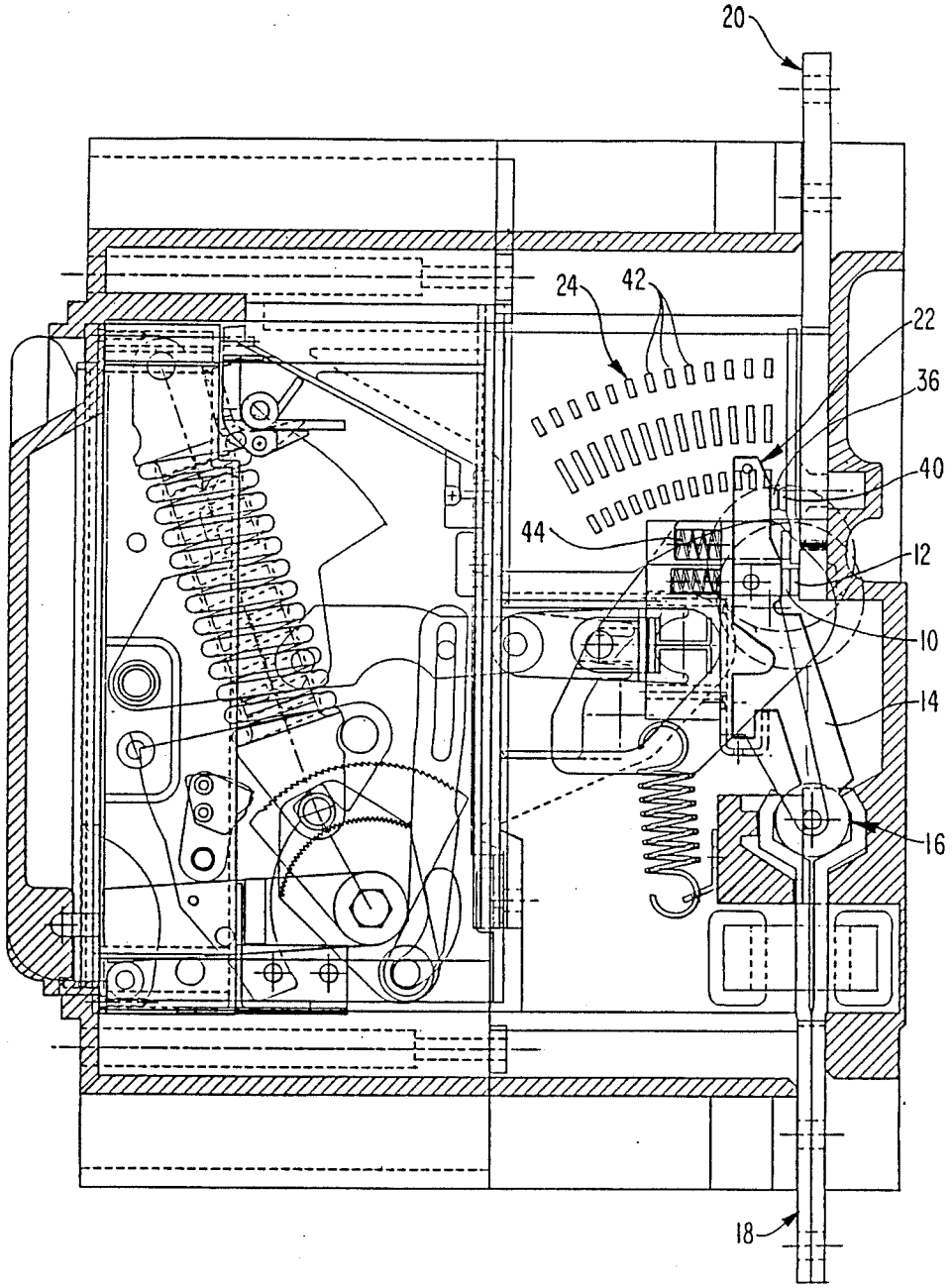
FIG. 1 is a side view of a circuit breaker including a pair of arcing contacts.
Figure 3:
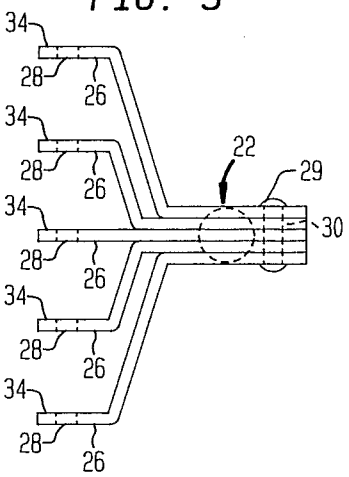
FIG. 3 is a top view of the arc horn.
Figure 4:
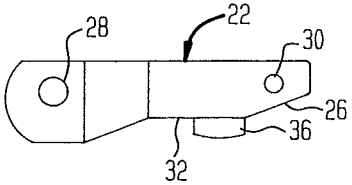
FIG. 4 is side view of the horn.
Figure 2:
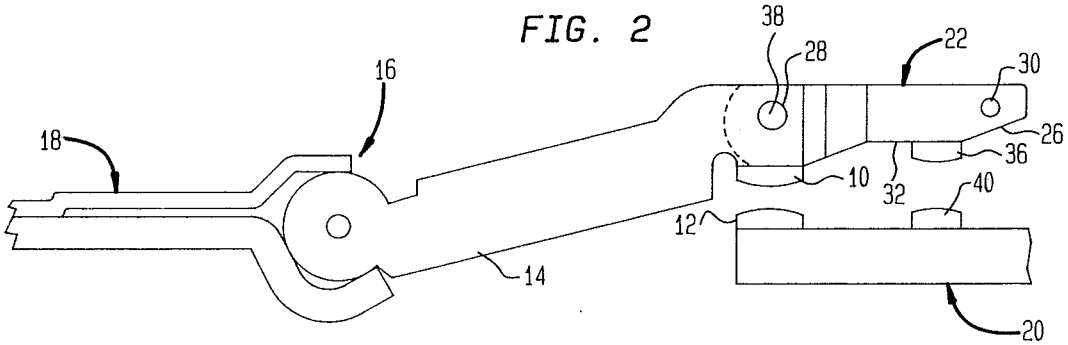
FIG. 2 is a side view of a contact arm including a pivotally attached arc horn.
Figure 5:
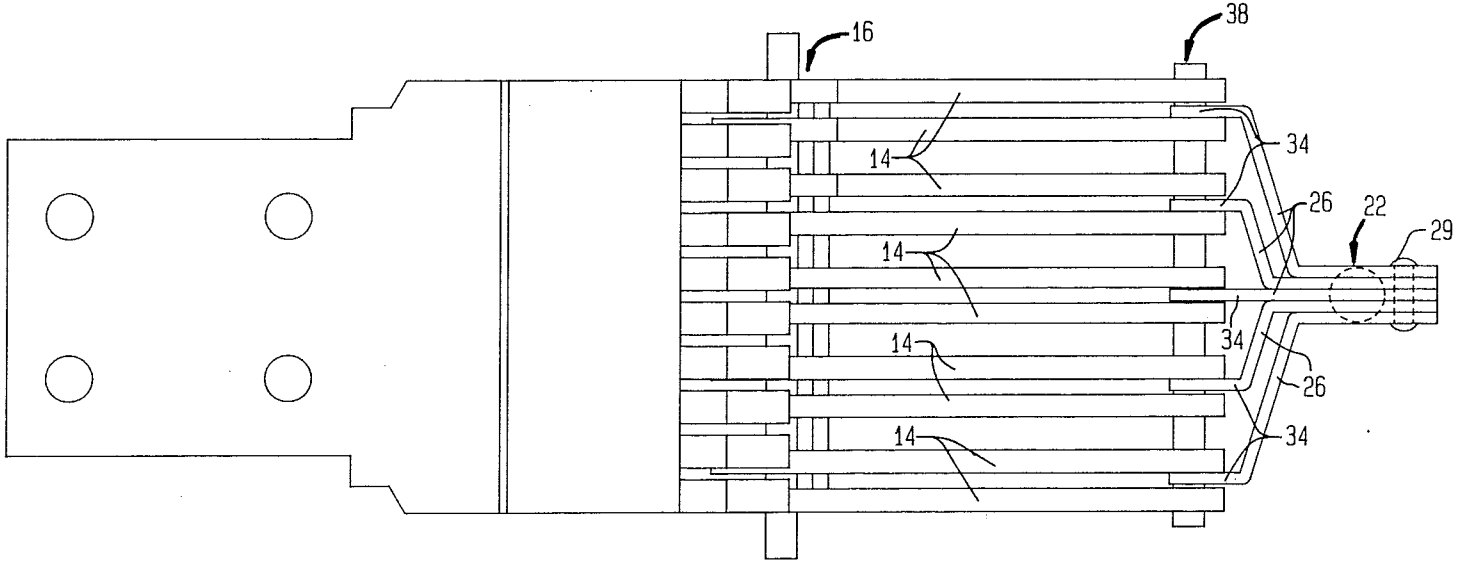
FIG. 5 is a top view of the contact arm assembly including the pivotally attached arc horn.

Referring now to FIG. 1, FIG. 1 illustrates a molded case circuit breaker including movable current carrying contacts 10 carried by a contact carrying arm 14, stationary current carrying contacts 12, an arcing contact assembly 22 and an arc chute 24. The pivoting contact carrying arm 14 cooperates with a pivot joint 16 such that the contacts 10, 12 can be opened and closed to control the flow of current between the terminals 18, 20 of the circuit breaker.

The preferred embodiment of the arcing contact assembly 22 is illustrated in more detail in FIGS. 2–5. The contact assembly 22 includes five arc channelling members 26 which each include a pivot hole 28 and a rivet hole 30. The members 26 are joined such that they form an arcing contact surface 32 and five contact carrying arm engaging portions 34. The members 26 are joined with a rivet 29 which passes through the rivet holes 30. The arcing contact surface 32 can be used as a location for attaching an arcing contact 36.

The engaging portions 34 are interposed between, and adjacent to, the contact carrying arms 14 such that the engaging portions 34 are separated by at least one contact carrying arm 14. To allow the arcing contact assembly 22 to pivot relative to the contact carrying arms 14, a pivot pin 38 engages the pivot holes 28 of the engaging portions 34 and the pivot holes of the contact carrying arms 14.

In general, the arcing contact assembly 22 functions to channel or funnel substantially all of the arcs which occur between the contacts 10, 12 into one arc between the contacts 36, 40. When the contact 10 is put into motion so that the contacts 10, 12 are separated, the mass of the arcing contact assembly 22 and spring 44 causes the assembly to pivot relative to the contact carrying arms 14 such that the contacts 36, 40 remain closed for a period of time after the contacts 10, 12 are opened. As the contacts 36, 40 are separated, one main arc is formed between the contacts 36, 40. As the contacts 36, 40 are further separated the main arc is extinguished into the arc chute 24, which includes a plurality of metal plates 42.

While one embodiment of an arcing assembly has been shown and described in detail herein, various other changes and modifications may be made without departing from the scope of the present invention.

We claim:

1. A circuit breaker comprising:

at least three stationary contacts for carrying current;

at least three movable contacts for carrying current;

at least three pivoting contact arms each defining a first end, wherein each arm carries one movable contact at the first end;

at least two arc carrying leads each defining a first end and a second end, wherein the first ends are joined to form a contact surface and each of the second ends is positioned adjacent to a pivoting contact arm and each of the second ends is separated from an adjacent second end by the first end of a pivoting contact arm; and means for pivotally attaching the second ends of the arc carrying leads at the first ends of the pivoting contact arms.

2. The circuit breaker of claim 1 further comprising an arcing contact fixed to the contact surface.

3. The circuit breaker of claim 2, wherein the first ends of the pivoting contact arms and the second ends of the arc carrying leads each include a pivot pin opening, and the means for pivotally attaching comprises a pivot pin adapted to pass through the pivot pin opening.

4. The circuit breaker of claim 3, wherein the first ends of the arc carrying leads are joined by a rivet.

5. A molded case circuit breaker comprising:

at least four stationary contacts for carrying current;

at least four movable contacts for carrying current;

at least four pivoting contact arms each defining a first end, wherein each arm carries one movable contact at the first end;

at least two arc carrying members each defining a first end and a second end, wherein the first ends are joined to form a junction and each of the second ends is positioned between two pivoting contact arms; and means for pivotally attaching the second ends of the arc carrying leads at the first ends of the pivoting contact arms.

6. The circuit breaker of claim 5 further comprising an arcing contact fixed to the junction.

7. The circuit breaker of claim 6, wherein the first ends of the pivoting contact arms and the second ends of the arc carrying leads each include a pivot pin opening, and the means for pivotally attaching comprises a pivot pin adapted to pass through the pivot pin opening.

8. The circuit breaker of claim 7, wherein the first ends of the arc carrying members are joined by a rivet.

9. An arcing contact assembly for a circuit breaker of the type including at least three stationary contacts for carrying current, at least three movable contacts for carrying current, and at least three pivoting contact arms each defining a first end, wherein each arm carries one movable contact at the first end, the arcing contact assembly comprising:

at least two arc channelling members each defining a first end and a second end, wherein the first ends are joined to form a contact surface and each of the second ends is adapted to be positioned adjacent to a pivoting contact arm and each of the second ends is adapted to be separated from an adjacent second end by the first end of a pivoting contact arm, the arc channeling members functioning to channel arcs from the contacts to the contact surface; means for pivotally attaching the second ends of the arc carrying leads at the first ends of the pivoting contact arms; and means for joining the second ends.

10. The arcing contact assembly of claim 9 further comprising an arcing contact fixed to the contact surface.

11. The arcing contact assembly of claim 10, wherein the first ends of the pivoting contact arms and the second ends of the arc carrying leads each include a pivot pin opening; and the means for pivotally attaching comprises a pivot pin adapted to pass through the pivot pin opening.

12. The arcing contact assembly of claim 10, wherein the means for joining the second ends comprises a rivet.

* * * * *